United States Patent [19]

Nagano

[11] 4,319,180

[45] Mar. 9, 1982

[54] REFERENCE VOLTAGE-GENERATING CIRCUIT

[75] Inventor: Katsumi Nagano, Hiratsuka, Japan

[73] Assignee: Tokyo Shibaura Denki Kabushiki Kaisha, Japan

[21] Appl. No.: 159,449

[22] Filed: Jun. 13, 1980

[30] Foreign Application Priority Data

Jun. 27, 1979 [JP] Japan ..... 54/80099

[51] Int. Cl.[3] ..... G05F 3/20

[52] U.S. Cl. ..... 323/313; 323/315

[58] Field of Search ..... 307/296 R, 297; 323/281, 311-317, 907; 330/296, 297

[56] References Cited

U.S. PATENT DOCUMENTS

| | | | |
|---|---|---|---|
| 3,781,648 | 12/1973 | Owens | 323/313 |
| 3,875,430 | 4/1975 | Prak | 323/315 X |
| 4,221,979 | 9/1980 | Ahmed | 307/296 R |
| 4,249,091 | 2/1981 | Yamagiwa | 307/297 X |

OTHER PUBLICATIONS

Carroll et al., "Constant Voltage Reference Source", IBM TDB, vol. 20, No. 8, Jan. 1978, pp. 3056, 3057.

Widlar, "New Developments in IC Voltage Regulators", IEEE Journal of Solid-State Circuits, vol. SC-6, No. 1, Feb. 1971, pp. 2-7.

Brokaw, "A Simple Three-Terminal IC Bandgap Reference", IEEE Journal of Solid-State Circuits, vol. SC-9, No. 6, Dec. 1974, pp. 388-393.

*Primary Examiner*—A. D. Pellinen

*Attorney, Agent, or Firm*—Finnegan, Henderson, Farabow, Garrett & Dunner

[57] ABSTRACT

A reference voltage circuit which generates a reference voltage having a good temperature characteristic as a drive voltage for a semiconductor integrated circuit, wherein a constant current source is connected to a power supply terminal; the output terminal of the constant current source is grounded through series-connected resistors; the junction of the series-connected resistors is connected to the bases of first and second NPN transistors; the first transistor has its collector connected to the constant current source, and its emitter grounded; the second transistor has its collector connected to the emitter of a third NPN transistor and its emitter grounded through a resistor; the third transistor has its base connected to the constant current source and its collector connected to the power supply terminal; and a reference voltage is sent forth from the emitter of the third transistor.

2 Claims, 2 Drawing Figures

REFERENCE VOLTAGE-GENERATING CIRCUIT

BACKGROUND OF THE INVENTION

This invention relates to a reference voltage-generating circuit, and more particularly to a reference voltage-generating circuit of simple arrangement which can produce a low reference voltage.

Recently in the field of a semiconductor device, prominent development is advancing with respect to an integrated circuit, large scale integrated (LSI) circuit and very large scale integrated (VLSI) circuit all constructed by forming a large number of semiconductor elements in a single chip. With these integrated circuits, each semiconductor element has to be biased by a prescribed level of reference voltage. To date, therefore, various reference voltage-generating circuits have been proposed. For example, a discussion (by R. J. Widlar) entitled "New Developments in IC Voltage Regulators" given in IEEE journal of solid-state circuits, Vol SC-6, No. 1, February 1971 discloses a circuit for generating a reference voltage corresponding to the extrapolated energy band-gap voltage of a semiconductor element. Since the conventional reference voltage-generating circuit produces a reference voltage having a higher level than 1 volt, the drive power source of this circuit should actually have a higher level of voltage than 1 volt. If, in case the conventional reference voltage-generating circuit is applied to an integrated circuit used with an apparatus such as a watch or camera which is operated by a power source of relatively low voltage, the power source voltage drops, than the reference voltage-generating circuit will be disabled. Therefore, the higher the level of reference voltage which the reference voltage circuit should produce, the narrower the range in which the reference voltage circuit can be operated, because of the necessity of providing drive power source having a higher level of voltage. With an integrated circuit biased by high voltage, each semiconductor element is generally demanded to have a higher withstand voltage, and consequently increases in size, resulting in a decline in the degree of integration. Further if biased by higher voltage, an integrated circuit will consume a larger amount of power, and rise in temperature due to Joule heat. This undesirable event deteriorates the property of the respective semiconductor elements, leading to a decline in the reliability of an integrated circuit.

SUMMARY OF THE INVENTION

It is accordingly the object of this invention to provide a reference voltage-generating circuit which has an excellent temperature characteristic and can generate a low level of reference voltage.

To this end, the present invention provides a reference voltage-generating circuit which comprises first and second power supply terminals, a constant current source and voltage-dividing means which are connected between the first and second power supply terminals, a first transistor whose base is connected to the voltage-dividing point of the voltage-dividing means, whose collector is connected to the junction of the constant current source and voltage-dividing means, and whose emitter is connected to the second power supply terminal, a second transistor whose base is connected to the base of the first transistor, and whose emitter is connected to the second power supply terminal through resistor means, a third transistor whose base is connected to the collector of the first transistor, and whose emitter is connected to the collector of the second transistor, and an output terminal which is connected to the emitter of the third transistor.

DETAILED DESCRIPTION OF THE INVENTION

Figure 1:
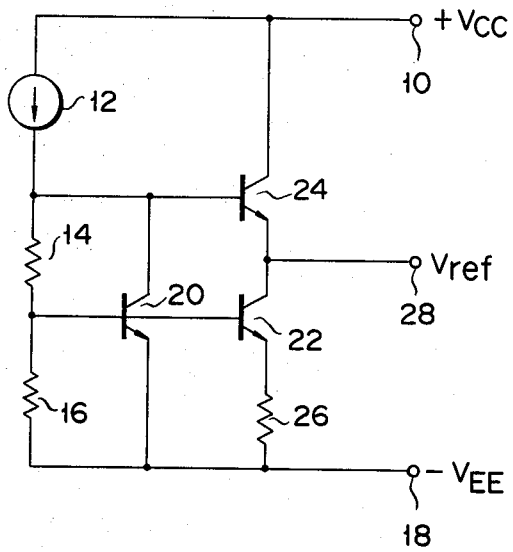
FIG. 1 shows the arrangement of a reference voltage-generating circuit embodying this invention.

FIG. 1 shows the arrangement of a reference voltage-generating circuit embodying this invention. A power supply terminal 10 impressed with voltage $+V_{CC}$ is connected to one end of a constant current source 12, the other end of which is connected to a power supply terminal 18 through series-connected resistors 14 and 16. The power supply terminal 18 is impressed with voltage $-V_{EE}$. The junction of the resistors 14 and 16 is connected to the base of an NPN type transistor 20, whose collector is connected to the junction of the constant current source 12 and resistor 14, and whose emitter is connected to the power supply terminal 18. The junction of the resistors 14 and 16 is also connected to the base of an NPN type transistor 22 whose collector is connected to the emitter of an NPN type transistor 24. The emitter of the transistor 22 is connected to the power supply terminal 18 through a resistor 26. The base of the transistor 24 is connected to the collector of the transistor 20. The collector of the transistor 24 is connected to the power supply terminal 10. An output terminal 28 is connected to the emitter of the transistor 24.

Description is now given of the operation of a reference voltage-generating circuit of FIG. 1. The base-emitter voltage $V_{BE}$ of a bipolar transistor is generally expressed as follows:

$$V_{BE} = V_{go}\left(1 - \frac{T}{T_0}\right) + V_{BE0}\left(\frac{T}{T_0}\right) + \frac{nkT}{q}\ln\left(\frac{T_0}{T}\right) + \frac{kT}{q}\ln\frac{I_C}{I_{C0}} \quad (1)$$

where:

$V_{go}$=extrapolated energy band-gap voltage for the semiconductor material at absolute zero q=the charge of an electron n=a constant that depends on how the transistor is made (approximately 1.5 for IC transistors)

k=Boltzmann's constant

T and $T_0$=absolute temperatures $I_C$=collector current $I_{C0}$=collector current at $T_0$ $V_{BE0}$=base-emitter voltage at $T_0$ and $I_{C0}$ Referring to FIG. 1, let it be assumed that the collector currents of the transistors 20 and 24 are respectively expressed as $I_{C1}$ and $I_{C3}$, and the base-emitter voltages of the transistors 20 and 24 are respectively expressed by $V_{BE1}$ and $V_{BE3}$. Then the base-emitter voltages $V_{BE1}$ and $V_{BE3}$ may be expressed from the equation (1) as follows:

$$V_{BE1} = V_{go}\left(1 - \frac{T}{T_0}\right) + V_{BE0}\left(\frac{T}{T_0}\right) + \frac{kT}{q}\ln\frac{I_{C1}}{I_{C0}} \quad (2)$$

$$V_{BE3} = V_{go}\left(1 - \frac{T}{T_0}\right) + V_{BE0}\left(\frac{T}{T_0}\right) + \frac{kT}{q}\ln\frac{I_{C2}}{I_{C0}} \quad (3)$$

The third term on the right side of the equation (1) has an extremely small value and is omitted from the equations (2) and (3).

A reference voltage $V_{ref}$ produced on the output terminal 28 may be expressed as follows:

$$V_{ref}=(1+\alpha)V_{BE1}=V_{BE3} \quad (4)$$

where:

$\alpha=R_1/R_2$ ($R_1$ in the resistance of the resistor 14 and $R_2$ in the resistance of the resistor 16)

When substituted by the equations (2) and (3), the equation (4) may be expressed as follows:

$$V_{ref}=\alpha V_{BE1}+\Delta V_{BE} \quad (5)$$

where:

$$\Delta V_{BE}=kT/q \ln I_{C1}/I_{C3} \quad (6)$$

$\Delta V_{BE}$ denotes a difference between the base-emitter voltage of the transistor 20 and that of the transistor 24, and has a positive temperature coefficient. The base-emitter voltage $V_{BE}$ has a negative temperature coefficient. Where, therefore, the coefficient $\alpha$ of the equation (5) is chosen to have a proper value, then it is possible to reduce the temperature coefficient of the reference voltage $V_{ref}$ to zero, that is, to set the reference voltage $V_{ref}$ at a prescribed level. To reduce the temperature coefficient to zero, it is advised to let the following equation have a value of zero which is obtained by differentiating the reference voltage $V_{ref}$ of the equation (5) by temperature T.

$$\frac{\partial V_{ref}}{\partial T} = \alpha\left(-\frac{V_{go}}{T_0} + \frac{V_{BE0}}{T_0} + \frac{k}{q}\ln\frac{I_{C1}}{I_{C0}}\right) + \frac{k}{q}\ln\frac{I_{C1}}{I_{C3}} \quad (7)$$

Assuming $I_{C1}\cong I_{C0}$, $\ln I_{C1}/I_{C0}$ has its value reduced to zero. Therefore, the equation (7) may be rewritten as follows:

$$\frac{\partial V_{ref}}{\partial T} = \alpha\left(-\frac{V_{go}}{T_0} + \frac{V_{BE0}}{T_0}\right) + \frac{k}{q}\ln\frac{I_{C1}}{I_{C3}} \quad (8)$$

Therefore, the requisite condition for reducing the temperature coefficient of the reference voltage $V_{ref}$ to zero may be expressed by the following equation.

$$\alpha\left(-\frac{V_{go}}{T_0} + \frac{V_{BE0}}{T_0}\right) + \frac{k}{q}\ln\frac{I_{C1}}{I_{C3}} = 0 \quad (9)$$

When substituted by the equation (9), the equation (5) may be rewritten as follows.

$$V_{ref} = \alpha\left\{V_{go}\left(1 - \frac{T}{T_0}\right) + V_{BE0}\left(\frac{T}{T_0}\right)\right\} - \alpha T\left(-\frac{V_{go}}{T_0} + \frac{V_{BE0}}{T_0}\right) = \alpha V_{go} \quad (10)$$

In other words, the temperature coefficient of the reference voltage $V_{ref}$ can be reduced to zero, if the reference voltage $V_{ref}$ is set at a value $\alpha$ times larger than that of the energy bund-gap voltage $V_{go}$.

Figure 2:
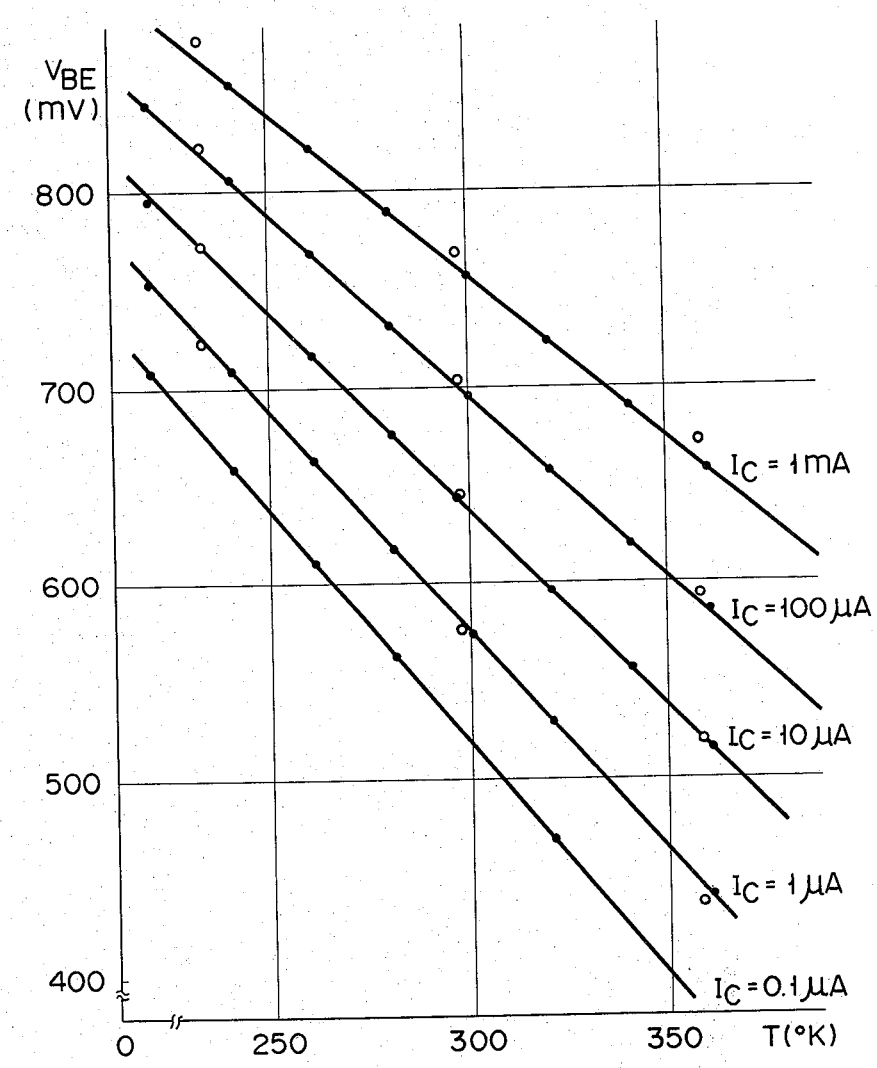
FIG. 2 graphically indicates the properties of a transistor used with the reference voltage-generating circuit of FIG. 1.

Description is now given of a concrete arrangement of a reference voltage-generating circuit, where it is desired to produce a reference voltage $V_{ref}$ of 200 mV. FIG. 2 shows the properties of an NPN transistor used with a reference voltage-generating circuit embodying this invention. Assuming $T_0=298°$ K. and $I_{C0}=10\ \mu A$, FIG. 2 shows the temperature characteristic of the relationship between the base-emitter voltage $V_{BE}$ and collector current $I_C$ of a transistor, with the voltage $V_{BE0}$ taken as a reference voltage. The mark of a circle denotes an actually measured value, and the mark of a black spot represents a value calculated from the equation (1). Where a reference voltage-generating circuit is designed, the various values of other semiconductor elements than the transistor 20 in which $I_{C1}$ is assumed to be 50 $\mu$A at T=298° K. are determined as follows on the basis of the transistor 20. At this time, the voltage $V_{BE1}$ is determined to be 682 mV from the equation (2). Where the temperature coefficient of the reference voltage $V_{ref}$ is reduced to zero, the following equation results from the equations (5) and (10).

$$V_{ref}=\alpha V_{BE1}+\Delta V_{BE}=\alpha V_{go} \quad (11)$$

Now assuming $V_{go}=1.205$ V, $\alpha=0.166$ and $V_{ref}=0.2$ V, then $\Delta V_{BE}$ is determined to be 86.8 mV from the equation (11). Where the value of $\Delta V_{BE}$ is substituted for the equation (6), then the following equation results:

$$I_{C3} = I_{C1}\, e^{-\frac{\Delta V_{BE}}{V_T}}$$

$$\left(\text{where } V_T = \frac{kT}{q}\ 25.7\ mV \text{ at } T = 298°\text{ K.}\right)$$

$$I_{C3} = 1.71\ \mu A$$

The transistors 20 and 22 jointly constitute a current mirror circuit. The collector current $I_{C2}$ of the transistor 22 has the same value as the collector current $I_{C3}$ of the transistor 24. Further, the base voltages of the transistors 20 and 22 have the same level. Therefore, the following equation results.

$$V_{BE1}=V_{BE2}+R_3 I_{C3} \quad (12)$$

where:

$V_{BE2}$=the base-emitter voltage of the transistor 22

$R_3$=the resistance of the resistor 26

When substituted by the equation (1), the equation (12) may be rewritten as follows:

$$R_3 = \frac{1}{I_{C3}}(V_{BE1} - V_{BE2}) = \frac{1}{I_{C3}}\cdot\frac{kT}{q}\ln\frac{I_{C1}}{I_{C2}} \quad (13)$$

-continued $$= \frac{1}{I_{C3}} \Delta V_{BE}$$

Where the above-equation (13) is substituted by $\Delta V_{BE}=86.8$ mV and $I_{C3}=1.71$ μA, then $R_3$ has a value of 50.8 kΩ. Where the constant current of the constant current source 12 is denoted by $I_0$, then the following equation results.

$$I_0 - I_{C1} = \frac{(1+\alpha)V_{BE1}}{R_1 + R_2} \quad (14)$$

Where the above-equation (14) is substituted by $\alpha=R_1/R_2=0.166$, $I_0=100$ μA, $I_{C1}=50$ μA and $V_{BE1}=682$ mV, then the resistor $R_1$ has a resistance of 2.26 kΩ, and the resistor $R_2$ has a resistance of 13.6 kΩ.

Where a reference voltage-generating circuit is arranged as shown in FIG. 1, then it is possible to produce as low a reference voltage as 200 mV.

The following are the results of experiments on the reference voltage-generating circuit of this invention arranged as described above.

Table 1 below shows variations in the base-emitter voltages $V_{BE1}$ and $V_{BE3}$ of the transistors 20 and 24, and also in differences $\Delta V_{BE}$ between the base-emitter voltages $V_{BE1}$ and $V_{BE3}$, that is, voltage drops which appear across the resistor 26. Experiments were carried out at the normal temperature (298° K.) with 20 samples of the transistor 20 and also 20 samples of the transistor 24.

TABLE 1

| | A number of samples |
|---|---|
| $V_{BE1}$ (mV) ($I_{C1}$ = 50 μA) | |
| 670 | 1 |
| 676 | 1 |
| 680 | 1 |
| 681 | 2 |
| 682 | 4 |
| 683 | 3 |
| 684 | 3 |
| 685 | 2 |
| 686 | 1 |
| 690 | 2 |
| $V_{BE3}$ (mV) ($I_{C3}$ = 1.7 μA) | |
| 586 | 1 |
| 595 | 1 |
| 598 | 2 |
| 599 | 2 |
| 600 | 5 |
| 601 | 2 |
| 602 | 1 |
| 603 | 2 |
| 604 | 1 |
| 605 | 1 |
| 608 | 1 |
| 609 | 1 |
| $\Delta V_{BE}$ (mV) | |
| 81 | 1 |
| 83 | 2 |
| 84 | 13 |
| 85 | 3 |
| 87 | 1 |

As apparent from Table 1 above, the transistors 20 and 24 indicated appreciably noticeable variations in the base-emitter voltages. However, the difference between the base-emitter voltages $V_{BE1}$ and $V_{BE3}$ of the tested samples of the transistors 20 and 24 which had substantially the same value (for example, 84) appeared in the greater part of the tested samples.

Table 2 below sets forth the results of experiments on the temperature characteristic of the reference voltage $V_{ref}$. Test was made of eight samples of a reference voltage-generating circuit.

TABLE 2

| $V_{ref}$(mV) | A number of samples |
|---|---|
| (T = 358° K.) | |
| 197 | 1 |
| 198 | 2 |
| 199 | 3 |
| 200 | 1 |
| 201 | 1 |
| (T = 298° K.) | |
| 199 | 2 |
| 200 | 6 |
| (T = 233° K.) | |
| 201 | 2 |
| 202 | 5 |
| 203 | 1 |

Determination was made from Table 2 above of how the reference voltage $V_{ref}$ varied with temperature, the results being set forth in Table 3 below. Where temperature changed, for example, from 298° K. to 233° K., then the percentage variation in the reference voltage $V_{ref}$ was defined by the following formula:

$$\frac{V_{ref}(298°\text{ K.}) - V_{ref}(233°\text{ K.})}{V_{ref}(298°\text{ K.})} \times 100$$

TABLE 3

| Percentage variation in $V_{ref}$(%) | A number of samples |
|---|---|
| (298° K. → 233° K.) | |
| −0.9 | 1 |
| −0.7 | 2 |
| −0.5 | 1 |
| −0.3 | 1 |
| 0.0 | 1 |
| 0.1 | 1 |
| 0.5 | 1 |
| (298° K. → 358° K.) | |
| 0.4 | 1 |
| 0.5 | 1 |
| 0.6 | 1 |
| 0.7 | 1 |
| 0.8 | 2 |
| 0.9 | 1 |
| 1.5 | 1 |

As seen from Table 3 above, the reference voltage generated by circuits embodying this invention has an excellent temperature characteristic.

With the foregoing embodiment, NPN type transistors were applied. However, it is possible to use PNP type transistors. In this case, it is advised to reverse the polarity of voltage impressed on a power supply terminal.

What is claimed is:

1. A reference voltage-generating circuit which comprises:

first and second power supply terminals (10, 18);

a constant current source (12), one end of which is connected to the first power supply terminal (10);

a voltage-dividing means (14, 16) connected between said constant current source (12) and second power supply terminal (18);

a first transistor (20) whose base is connected to the voltage-dividing point of said voltage-dividing means (14, 16), whose collector is connected to the junction of said constant current source (12) and voltage-dividing means (14, 16), and whose emitter is connected to said second power supply terminal (18);

a second transistor (22) whose base is connected to the base of said first transistor (20);

a resistor means (26) which is connected between said second transistor (22) and second power supply terminal (18);

a third transistor (24) whose base is connected to the collector of said first transistor (20), whose collector is connected to said first power supply terminal (10), and whose emitter is connected to the collector of said second transistor (22); and an output terminal (28) which is connected to the emitter of said third transistor (24).

2. The reference voltage-generating circuit according to claim 1, wherein said first power supply terminal (10) is impressed with positive voltage; said second power supply terminal (18) is supplied with negative voltage; and said first to third transistors are NPN type transistors.

* * * * *